United States Patent [19]

von Laar et al.

[11] Patent Number: 4,852,461

[45] Date of Patent: Aug. 1, 1989

[54] ARMORED VEHICLE WITH TOP-MOUNTED BARRELED WEAPON

[75] Inventors: Klaus von Laar, Lauf/Pegn.; Hans Sackenreuter, Ruckersdorf; Werner Heberlein, Nuremberg, all of Fed. Rep. of Germany

[73] Assignee: Diehl GmbH & Co., Nuremberg, Fed. Rep. of Germany

[21] Appl. No.: 887,180

[22] Filed: Jul. 7, 1986

[30] Foreign Application Priority Data

Jul. 12, 1985 [DE] Fed. Rep. of Germany ..... 3524924

[51] Int. Cl.[4] ..... F41F 9/06

[52] U.S. Cl. ..... 89/46; 89/7; 89/33.03; 89/36.13

[58] Field of Search ..... 89/7, 33.03, 34, 36.08, 89/36.13, 46

[56] References Cited

U.S. PATENT DOCUMENTS

| | | | |
|---|---|---|---|
| 2,403,883 | 7/1946 | Thomas | 89/46 |
| 2,427,352 | 9/1947 | De Sanders | 89/36.08 |
| 3,139,798 | 7/1964 | Aldrin | 89/46 |
| 4,391,179 | 7/1983 | Tidstrom | 89/36.13 |
| 4,429,616 | 2/1984 | Grosser | 89/36.13 |
| 4,599,933 | 7/1986 | Stoner | 89/33.03 |
| 4,603,615 | 8/1986 | Ashley | 89/7 |

FOREIGN PATENT DOCUMENTS

| | | |
|---|---|---|
| 1578069 | 1/1971 | Fed. Rep. of Germany . |
| 2837303 | 3/1980 | Fed. Rep. of Germany . |
| 396700 | 11/1962 | Switzerland . |

*Primary Examiner*—Stephen C. Bentley

*Attorney, Agent, or Firm*—Scully, Scott, Murphy & Presser

[57] ABSTRACT

An armored vehicle with an overhead or top-mounted cannon or barreled weapon, which is supported in a forked cradle support so as to be elevatable about a bearing trunnion axis, and which includes an arrangement for the storge of the ammunition and the conveyance of the ammunition from a main storage magazine and from an auxiliary storage magazine. A vertically standing projectile loading tube or barrel is rotatable about its longitudinal axis, whose longitudinal axis concurrently consists of the azimuthal or bearing axis of the barreled weapon, and which, in the position of rest of the barreled weapon, intersects at one point with trunnion axis and the tilting axis of the rotary shell or projectile chamber of the barreled weapon. Hereby, independently of the elevation of the barreled weapon, the shell or projectile chamber is movable into a vertical position extending coaxially with the loading tube.

4 Claims, 2 Drawing Sheets

ARMORED VEHICLE WITH TOP-MOUNTED BARRELED WEAPON

BACKGROUND OF THE INVENTION

1. Field of the Invention

The present invention relates to an armored vehicle with an overhead or top-mounted cannon or barreled weapon, which is supported in a forked cradle support so as to be elevatable about a bearing trunnion axis, and which includes an arrangement for the storage of the ammunition and the conveyance of the ammunition from a main storage magazine and from an auxiliary storage magazine.

2. Discussion of the Prior Art

From the disclosure of German Patent No. 28 37 303, there has become known an arrangement for the storage of ammunition and for the conveyance of ammunition in an armored vehicle incorporating a top-mounted cannon. The cannon is supported so a to be elevatable within a forked cradle support. A main storage magazine is fixedly connected with the chassis of the vehicle, whereas an intermediate or temporary storage magazine takes part in the lateral or sideways movement of the cannon barrel. The projectiles are raised towards the weapon though the intermediary of a hoist loading deice from a rearwardly-located storage component, and introduced into the shell chamber of the weapon. In order to facilitate the loading of the gun barrel from an ammunition storage magazine when the gun barrel is elevated, as well as being rotated about the azimuthal or bearing axis, a rotatable armored turret must be provided for the armored vehicle. Within this rotatable armored turret there is located the ammunition storage which, consequently, is imparted the rotations of the turret and of the gun barrel, and which facilitates the loading even after the rotation of the gun barrel. Independently of the aspect that an armored turret, together with all of its necessary installations, is extremely complicated from the standpoint of its technology, during attack by an enemy it presents a preferred target due to the raised construction above the armored vehicle.

SUMMARY OF THE INVENTION

Accordingly, it is an object of the present invention to provide an armored vehicle with a top-mounted barreled weapon of the above-mentioned type which is adequate without an armored turret, from the standpoint of weapon equipment and ammunition storage, as well as delivery of ammunition.

Inventively, the foregoing object is achieved through the provision of a vertically standing projectile loading tube or barrel which is rotatable about its longitudinal axis, whose longitudinal axis concurrently consists of the azimuthal or bearing axis of the barrelled weapon, and which, in the position or rest of the barrelled weapon, intersects at one point with the trunnion axis and the tilting axis of the rotary shell or projectile chamber of the barreled weapon. Hereby, independently of the elevation of the barreled weapon, the shell or projectile chamber is movable into a vertical position extending coaxially with the loading tube. The loading tube, at its head end, can possess the forked cradle support for receiving the bearing trunnions, and at its head end as well as its foot end, can be rotatably supported in pivot bearings of the vehicle body while secured against axial displacement.

Pursuant to an advantageous feature of the invention, the projectiles can be stored separated from the propellant components in the interior of the vehicle, and conveyed towards as well as through the loading tube, whereas the propellant components can be located outside of the vehicle body, or at least partitioned off from the crew compartment. A liquid propellant in tank containers can be positioned outside of the vehicle body, which can be conveyed through pipe conduits into the weapon component rearwardly of the pivotable projectile chamber. Alternatively thereto, a solid propellant can be provided in propellant casings or as a caseless propellant, which can be brought, by means of a loading hoist, into the weapon portion rearwardly of the pivotable projectile chamber, independently of the elevational and azimuthal position of the barreled weapon.

The significant concept of the invention can be ascertained in that the loading tube has its longitudinal axis located in the axis of rotation of the barreled weapon, and as a result, concurrently represents the azimuthal or bearing axis of the weapon barrel. In addition thereto is the inventive arrangement of the pivotable projectile chamber, with the basic concept that in the position of rest of the weapon barrel, the trunnion axis, tilting axis and axis of elevation will all intersect at one point. The delivery of the projectile is always effected through the hollow pivoting or elevational axis of the barreled weapon. The pivotable projectile chamber can always be brought into a vertical position independently of the elevation of the weapon, in order to facilitate the delivery of the projectiles.

As a result, an indexing position for effecting the loading is not required. Through the inventive arrangement of the loading tube, there is eliminated the armored turret from view of the barreled weapon, which affords a significant technological advantage, inasmuch as, resultingly, the armored vehicle, on the one hand, can be built relatively low in height, and on the other hand, there can be eliminated technologically complex installations and superstructures. Consequently, the armored vehicle becomes lighter in weight which renders it more economical, and offers an improved protection against attack due to a reduced surface exposure.

Further advantages of this inventive armored vehicle with the top-mounted barreled weapon can be ascertained, in that the propellant components are always partitioned off from the crew compartment and, in a preferred instance, can even be arranged outside of the body of the armored vehicle under separated conditions. Thereby, only the projectiles are located interiorly of the vehicle. Thus, upon a hit being sustained by the armored vehicle, the explosive propellant components are destroyed and blasted off; however, the armored vehicle remains capable of travel. However, above all, a hit encountered by the propellant components will not concurrently lead to injuries to the personnel.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
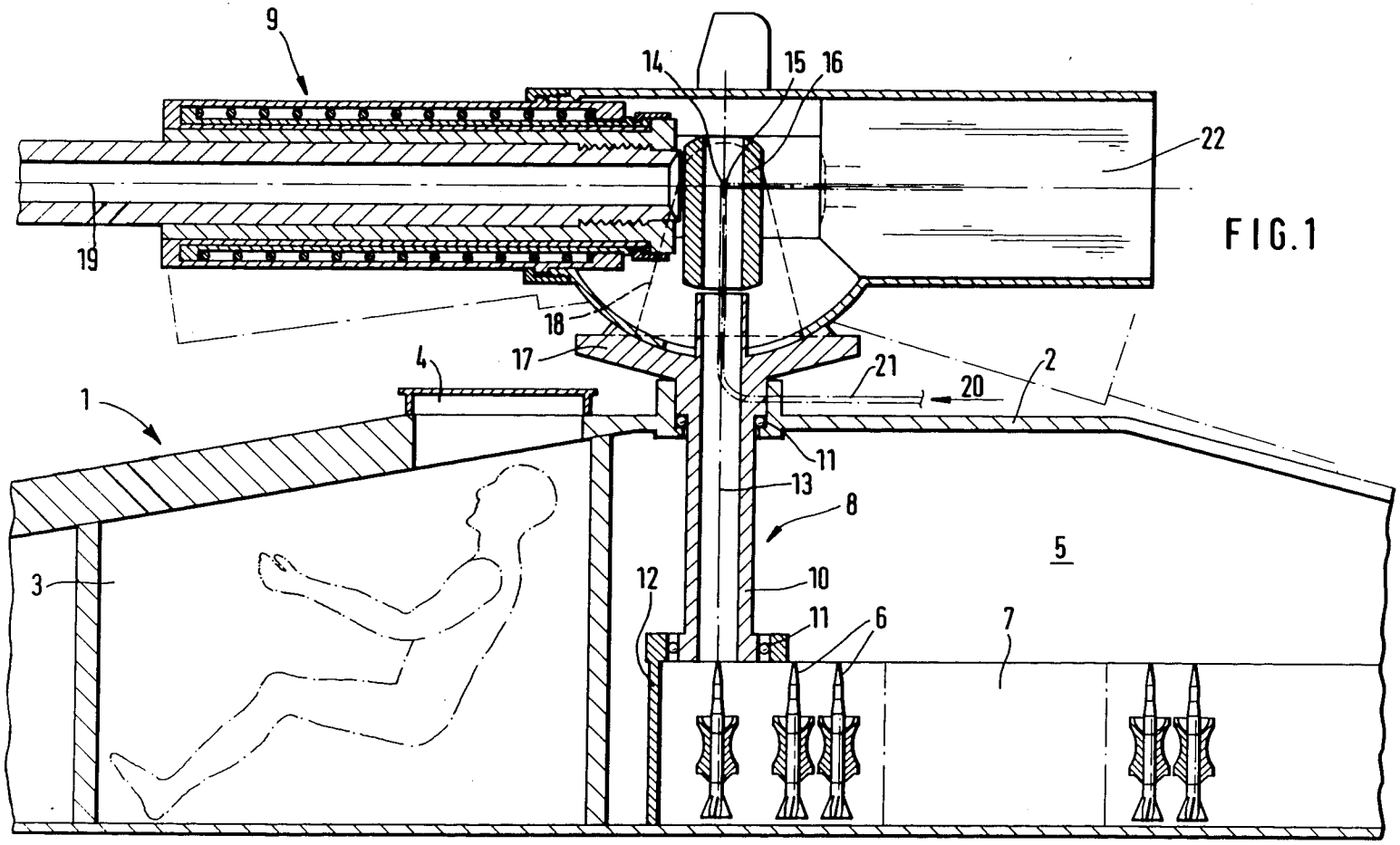
FIG. 1 illustrates, in a longitudinal section, the inventive portion of an armored vehicle possessing a top-mounted barreled weapon.

The armored vehicle 1 illustrated in the drawings is built with a relatively low profile and at its upper end is bounded by the body roof 2. Arranged in the forward portion is the crew compartment 3 with the upper entry hatch 4; whereas, in the rearwardly located equipment space 5 provision is made for the stowage of the projectiles 6 in a magazine 7 and the delivery device 8 for conveying the projectiles to the weapon barrel.

The projectile delivery device 8 essentially consists of a loading tube 10 which is oriented vertically and is rotatable about its longitudinal axis. For this purpose, the loading tube 10 is supported at its head end as well as its foot end in pivot bearings 11 within the vehicle body 2, or effectively, in wall portions 12 of the armored vehicle. The longitudinal axis of the loading tube 10 is also concurrently the azimuthal or bearing axis 13 of the barrelled weapon 9, and in the position or rest of the barrelled weapon, intersects at a single point with the trunnion axis 14 and the tilting axis 15 of the pivotable projectile chamber 16 of the barreled weapon 9.

At its head end, the loading tube 10 widens into a platform 17, on which there is constructed a fork-shaped cradle support 18. The barrelled weapon 9 is supported through its trunnion axis 14 in the fork-shaped cradle support 18. The pivotable projectile chamber 16 is oriented in a vertical position procedure, coaxially with the loading tube 10. After the receiving of a projectile 6 which, for example, through the intermediary of a suitable device (not shown) is inserted through the loading tube 10 into the pivotable projectile chamber 16, this pivotable projectile chamber 16 is pivoted so that its longitudinal axis is in a coaxial orientation with respect the bore axis of the weapon barrel, and then locked in position.

In the example of FIG. 1, the propellant is liquid and is conducted from propellant tanks 20, which can be located outside the vehicle and thereby be separated from the projectiles, through suitable pipe conduits 21 into the weapon portion 22 rearwardly of the pivotable projectile chamber 16.

Figure 2:
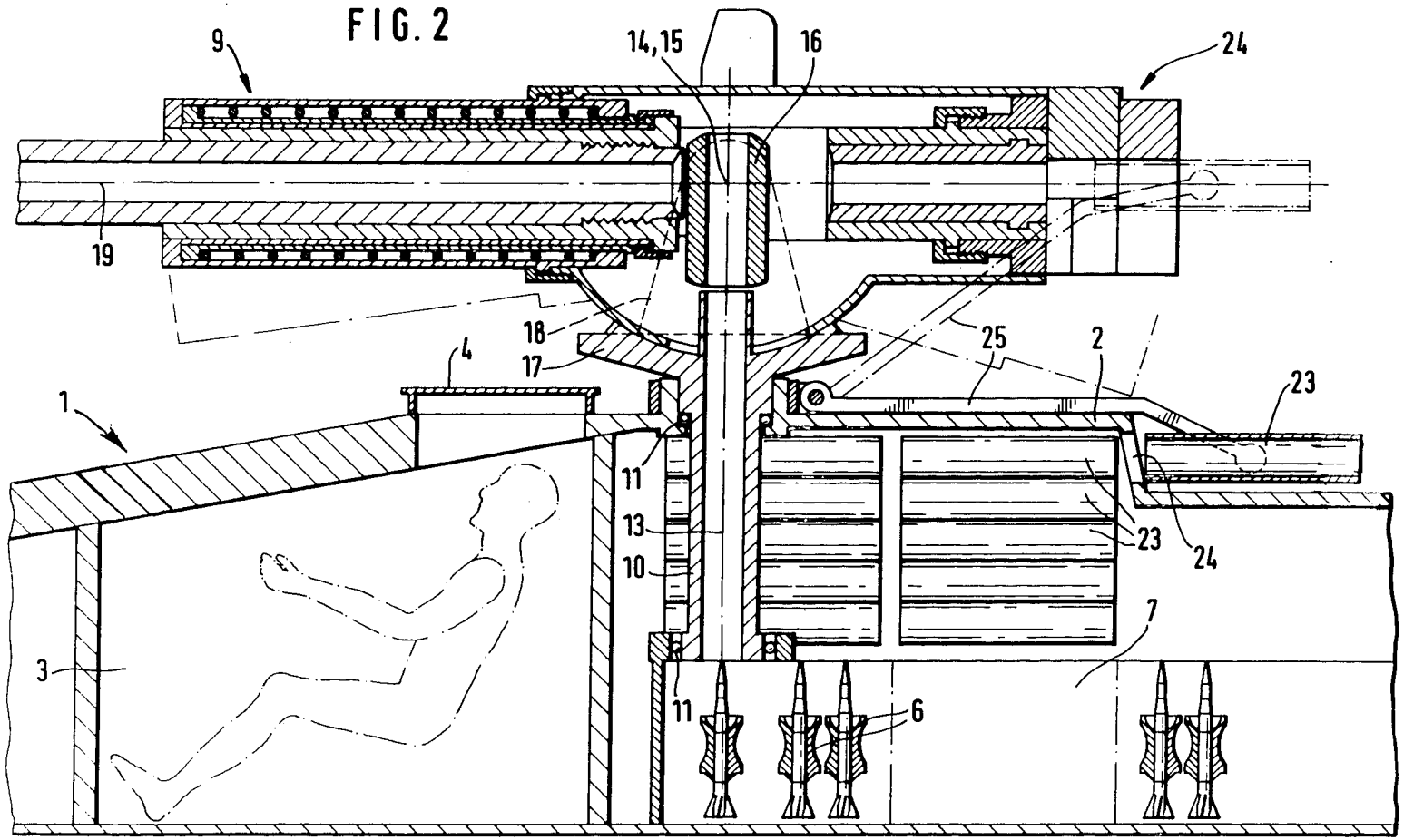
FIG. 2 illustrates, in a similar sectional view, the inventive portion of the armored vehicle with the top-mounted barreled weapon and further propellant compartments of the ammunition.

The alternative solution to the use of the liquid propellants is illustrated in FIG. 2, in which the propellant is a solid and is arranged in propellant casings 23 or is a caseless propellant. The propellant casings 23 can be stored in the rear equipment region 5 of the armored vehicle 1, in the illustrated horizontal, as well as in a vertical orientation not shown herein. The propellant casings 23 are transported to the outside from the storage space 5 through an opening 24 in the armored vehicle, and from here introduced by means of a loading hoist 25 into the weapon portion 22 rearwardly of the pivotable projectile chamber 26. The loading hoist 25 is provided for the case of a propellant contained in propellant casings to act as a loading device, as well as a casing ejector device. The loading hoist 25 brings the propellant casings 23 into the correct loading position independently of the elevation of the weapon 9. The remaining arrangement and the overall construction of the armored vehicle 1 remain the same as that described with respect to FIG. 1.

The collective details illustrated in the figures of the drawings and elucidated in the specification are important to the invention.

What is claimed:

1. An armored vehicle including a top-mounted barreled weapon, a fork-shaped cradle support supporting said barreled weapon on trunnions for elevation about a being trunnion axis; an arrangement for the storage of ammunition and for the infeed of the ammunition to said weapon from a storage magazine; said arrangement including a vertically extending loading tube which is rotatable about its longitudinal axis; a pivotable projectile chamber operatively associated with the barrel of said weapon and which is pivotable from a position in alignment with the bore axis of said weapon barrel into a vertical position extending coaxially with the loading tube independently of the elevation of the barreled weapon, the longitudinal axis of said loading tube being concurrently the azimuthal axis of the weapon barrel and intersecting with the trunnion axis and the pivoting axis of said pivotable projectile chamber at a single point of intersection, said fork-shaped cradle support being arranged on the end of said loading tube facing said weapon for the receipt of said trunnions, and bearing means for rotatably supporting said loading tube about the longitudinal axis of said tube at the end extending towards said weapon and at the end extending towards the magazine.

2. Armored vehicle as claimed in claim 1, wherein projectiles are stored in the interior of the vehicle separated from propellent charges and are transportable towards a transfer location and through the loading tube, and said propellent charges are arranged on the outside of the armored vehicle and are partitioned off from a crew compartment in said vehicle.

3. Armored vehicle as claimed in claim 1, wherein a liquid propellant is arranged in tank containers mounted on the outside of the armored vehicle.

4. Armored vehicle as claimed in claim 1, wherein a loading hoist is adapted to convey a solid propellant arranged in propellant casings or a caseless propellant into said pivotable projectile chamber.

* * * * *